US009429020B2

(12) United States Patent
Forni

(10) Patent No.: US 9,429,020 B2
(45) **Date of Patent: *Aug. 30, 2016**

(54) SCROLL PUMP HAVING AXIALLY COMPLIANT SPRING ELEMENT

(71) Applicant: AGILENT TECHNOLOGIES, INC., Loveland, CO (US)

(72) Inventor: Ronald J. Forni, Lexington, MA (US)

(73) Assignee: Agilent Technologies, Inc., Santa Clara, CA (US)

( * ) Notice: Subject to any disclaimer, the term of this patent is extended or adjusted under 35 U.S.C. 154(b) by 116 days.

This patent is subject to a terminal disclaimer.

(21) Appl. No.: 14/102,943

(22) Filed: Dec. 11, 2013

(65) Prior Publication Data

US 2015/0159650 A1 Jun. 11, 2015

(51) Int. Cl.

*F03C 2/00* (2006.01)
*F03C 4/00* (2006.01)
*F04C 2/00* (2006.01)
(Continued)

(52) U.S. Cl.

CPC ..... *F01C 21/02* (2013.01); *F01C 1/0215* (2013.01); *F01C 19/08* (2013.01); *F04C 18/0215* (2013.01); *F04C 27/005* (2013.01); *F04C 27/008* (2013.01); *F04C 29/0021* (2013.01); *F04C 29/0057* (2013.01); *F04C 23/008* (2013.01); *F04C 25/02* (2013.01); *F04C 2240/50* (2013.01); *F04C 2240/807* (2013.01)

(58) Field of Classification Search

CPC ..... F04C 18/2015; F04C 18/0284; F04C 23/008; F04C 29/0021; F04C 27/001; F04C 27/005; F04C 27/007; F04C 27/008; F04C 2240/50; F04C 2240/807; F01C 1/0215; F01C 1/0284; F01C 19/10; F01C 19/08

USPC ..... 418/55.1–55.6, 57, 142, 270

See application file for complete search history.

(56) References Cited

U.S. PATENT DOCUMENTS 1,376,291 A 4/1921 Rolkerr
3,817,664 A 6/1974 Bennett et al.
(Continued)

FOREIGN PATENT DOCUMENTS

CN 204025042 U 12/2014
EP 2594797 5/2013
(Continued)

OTHER PUBLICATIONS

Search Report mailed Sep. 18, 2014 in GB Application No. 1400482.4.
(Continued)

*Primary Examiner* — Theresa Trieu

(57) ABSTRACT

A scroll pump includes a frame, a stationary plate scroll, an orbiting plate scroll, a non-energized type of tip seal or seals, an eccentric drive mechanism assembled to and supported by the frame and to which the orbiting plate scroll is assembled so as to be drivable by the eccentric drive mechanism in an orbit about a longitudinal axis of the pump, and an axial compliance system including a flexure. The flexure is interposed between a bearing of the eccentric drive mechanism and a flexure-locating surface of the eccentric drive mechanism. The flexure allows the orbiting plate scroll to move away from the stationary plate scroll in the case of an assembly process which would otherwise result in the tip seal(s) being too forcefully engaged with the plate of the opposing plate scroll.

17 Claims, 5 Drawing Sheets

(51) Int. Cl.

| | |
|---|---|
| ***F01C 21/02*** | (2006.01) |
| ***F04C 29/00*** | (2006.01) |
| ***F04C 27/00*** | (2006.01) |
| ***F01C 1/02*** | (2006.01) |
| ***F01C 19/08*** | (2006.01) |
| ***F04C 18/02*** | (2006.01) |
| *F04C 23/00* | (2006.01) |
| *F04C 25/02* | (2006.01) |

(56) References Cited

U.S. PATENT DOCUMENTS

| | | | | |
|---|---|---|---|---|
| 3,994,636 | A * | 11/1976 | McCullough et al. | 418/142 |
| 4,731,000 | A | 3/1988 | Haag | |
| 4,795,323 | A | 1/1989 | Lessie | |
| 4,892,469 | A * | 1/1990 | McCullough et al. | 418/55.5 |
| 4,927,340 | A | 5/1990 | McCullough | |
| 5,051,075 | A | 9/1991 | Young | |
| 5,149,255 | A | 9/1992 | Young | |
| 5,452,995 | A * | 9/1995 | Izumi et al. | 418/55.5 |
| 6,022,202 | A | 2/2000 | Pottier et al. | |
| 6,506,036 | B2 * | 1/2003 | Tsubai et al. | 418/55.5 |
| 7,442,016 | B2 | 10/2008 | Dovey et al. | |
| 2006/0051225 | A1 | 3/2006 | Dovey et al. | |
| 2006/0051227 | A1 * | 3/2006 | Tarng | 418/55.5 |
| 2007/0003424 | A1 * | 1/2007 | Benco et al. | 418/55.1 |

FOREIGN PATENT DOCUMENTS

| | | | |
|---|---|---|---|
| JP | H09133086 | A | 5/1997 |
| WO | WO2005045249 | | 5/2005 |

OTHER PUBLICATIONS

Office Action mailed Apr. 27, 2015 in co-pending U.S. Appl. No. 14/272,389.

GB Search Report dated May 26, 2015.

* cited by examiner

SCROLL PUMP HAVING AXIALLY COMPLIANT SPRING ELEMENT

BACKGROUND OF THE INVENTION

1. Field of the Invention

The present invention relates to a scroll pump which includes plate scrolls having nested scroll blades, and a tip seal(s) that provides a seal between the tip of the scroll blade of one of the plate scrolls and the plate of the other plate scroll.

2. Description of the Related Art

A scroll pump is a type of pump that includes a stationary plate scroll having a spiral stationary scroll blade, and an orbiting plate scroll having a spiral orbiting scroll blade. The stationary and orbiting scroll blades are nested with a clearance and predetermined relative angular positioning such that a pocket (or pockets) is delimited by and between the scroll blades. The scroll pump also has a frame to which the stationary plate scroll is fixed and an eccentric drive mechanism supported by the frame. These parts generally make up an assembly that may be referred to as a pump head (assembly) of the scroll pump.

The orbiting plate scroll and hence, the orbiting scroll blade, is coupled to and driven by the eccentric driving mechanism so as to orbit about a longitudinal axis of the pump passing through the axial center of the stationary scroll blade. The volume of the pocket(s) delimited by the scroll blades of the pump is varied as the orbiting scroll blade moves relative to the stationary scroll blade. The orbiting motion of the orbiting scroll blade also causes the pocket(s) to move within the pump head assembly such that the pocket(s) is selectively placed in open communication with an inlet and outlet of the scroll pump.

In an example of such a scroll pump, the motion of the orbiting scroll blade relative to the stationary scroll blade causes a pocket sealed off from the outlet of the pump and in open communication with the inlet of the pump to expand. Accordingly, fluid is drawn into the pocket through the inlet. Then the pocket is moved to a position at which it is sealed off from the inlet of the pump and is in open communication with the outlet of the pump, and at the same time the pocket is collapsed. Thus, the fluid in the pocket is compressed and thereby discharged through the outlet of the pump. The sidewall surfaces of the stationary orbiting scroll blades need not contact each other to form a satisfactory pocket(s). Rather, a minute clearance may be maintained between the sidewall surfaces at the ends of the pocket(s).

A scroll pump as described above may be of a vacuum type, in which case the inlet of the pump is connected to a chamber that is to be evacuated.

Furthermore, oil may be used to create a seal between the stationary and orbiting plate scroll blades, i.e., to form a seal(s) that delimits the pocket(s) with the scroll blades. On the other hand, certain types of scroll pumps, referred to as "dry" scroll pumps, avoid the use of oil because oil may contaminate the fluid being worked by the pump. Instead of oil, dry scroll pumps employ a tip seal or seals each seated in a groove extending in and along the length of the tip (axial end) of a respective one of the scroll blades (the groove thus also having the form of a spiral). More specifically, each tip seal is provided between the tip of the scroll blade of a respective one of the plate scrolls and the plate of the other of the plate scrolls, to create a seal which maintains the pocket(s) between the stationary and orbiting scroll blades. Further in this respect, scroll pumps of the type described above typically require a certain degree of axial compliance among respective parts of the pump head assembly to maintain an effective seal between the opposing scroll blades and plates.

In general, there are two types of tip seal arrangements to meet these requirements: energized and non-energized. An energized type of tip seal arrangement includes a tip seal seated in the tip of the scroll blade of one of the plate scrolls, and a spring that biases the tip seal against the plate of the other of the plate scrolls. A typical non-energized type of tip seal arrangement has only a solid plastic tip seal seated in the tip of the scroll blade of one of the plate scrolls and the solid plastic tip seal directly confronts the plate of the other of the plate scrolls.

In the spring-biased tip seal arrangements, the friction produced by the engagement of the tip seal with the opposing scroll plate is limited in that it does not exceed a value corresponding to the maximum force that can be exerted by the spring on the tip seal. However, spring-biased tip seals are continuously worn because they are constantly biased into engagement with the opposing scroll plate. As a result, spring-biased tips seals must be replaced rather frequently. The solid plastic tip seals of the non-energized arrangements have a relatively longer useful life than the conventional spring-biased tip seals. However, the use of solid tip seals presents its own set of problems.

For instance, the tolerances of axial dimensions of various components of scroll pumps that employ non-energized tip seals must be maintained within narrow ranges to ensure that the tips seals are properly positioned in the pump head. More specifically, precise axial positioning ensures that any gap between a solid tip seal and the opposing scroll plate is minimal. If, the gap is too large, the tip seal will not produce an effective seal with the opposing scroll plate. However, if the tip seal is compressed too much between the scroll blade and the opposing scroll plate, the resulting friction and heat can overload and damage not only the seal itself but also parts of the pump such as the bearings of the drive mechanism.

SUMMARY OF THE INVENTION

The present invention is provided to overcome one or more of the problems, disadvantages and/or limitations presented by the use of a non-energized type of tip seal in a scroll pump.

One object of the present invention is to provide a scroll pump in which a tip seal(s) of the pump will be produce an effective seal with an opposing scroll plate without overloading and/or damaging components of the pump, at the time a pump head of the pump is assembled.

Another object of the present invention is to provide a scroll pump having pump head components whose axial dimensions may enjoy a wide range of tolerances and yet in which the tip seal(s) of the pump are ensured of producing an optimal seal with an opposing scroll pump at the time a pump head of the pump is assembled.

According to one aspect of the present invention there is provided a scroll pump including a frame, a stationary plate scroll fixed relative to the frame, an orbiting plate scroll, a tip seal(s) interposed between an axial end of the scroll blade of a respective one of the stationary and orbiting plate scrolls and the plate of the other of the stationary plate and orbiting plate scrolls, an eccentric drive mechanism supported by the frame, operative to drive the orbiting plate scroll in an orbit about the longitudinal axis, and including a crankshaft and bearings, and a flexure having compliance in an axial direction parallel to the longitudinal axis of the pump. The orbiting plate scroll is carried by the crank of the crankshaft, and the main portion of the crankshaft is supported by the frame via the bearings. Furthermore, the eccentric drive mechanism has an axially facing flexure-locating surface, one of the bearings is a flexure-locating bearing, the crankshaft of the eccentric drive mechanism is supported such that it is movable axially relative to the flexure-locating bearing, and the flexure is axially interposed between the axially facing flexure-locating surface and the flexure-locating bearing of the eccentric drive mechanism.

According to another aspect of the present invention, there is provided a scroll pump including a frame, a stationary plate scroll fixed relative to the frame, an orbiting plate scroll, a tip seal(s) interposed between an axial end of the scroll blade of a respective one of the stationary and orbiting plate scrolls and the plate of the other of the stationary plate and orbiting plate scrolls, an eccentric drive mechanism supported by the frame and operative to drive the orbiting plate scroll in an orbit about the longitudinal axis, and an axial compliance system including at least one spring and a flexure having compliance in the axial direction of the pump. The eccentric drive mechanism includes a drive shaft, and bearings each having an inner race, an outer race and rolling elements interposed between the inner and out races. The drive shaft comprises a crankshaft having a main shaft and a crank. Also, the eccentric drive mechanism has an axially facing flexure-locating surface, and the crankshaft is supported such that it is movable axially relative to the inner races of the bearings. The outer races of respective ones of the bearings are coupled to the frame and the orbiting plate scroll, the inner races of the respective ones of the bearings are disposed on the main shaft and the crank, the main shaft is supported by the frame, and the orbiting plate scroll is carried by the crank via the bearings. The at least one spring of the axial compliance system serves to clamp the inner races of the bearings axially, and the flexure is interposed in an axial direction, parallel to the longitudinal axis of the pump, between the inner race of one of the bearings and the axially facing flexure-locating surface of the eccentric drive mechanism.

BRIEF DESCRIPTION OF THE DRAWINGS

These and other objects, features and advantages of the present invention will be better understood from the detailed description of the preferred embodiments thereof that follows with reference to the accompanying drawings, in which.

DETAILED DESCRIPTION OF THE PREFERRED EMBODIMENTS

Figure 1:
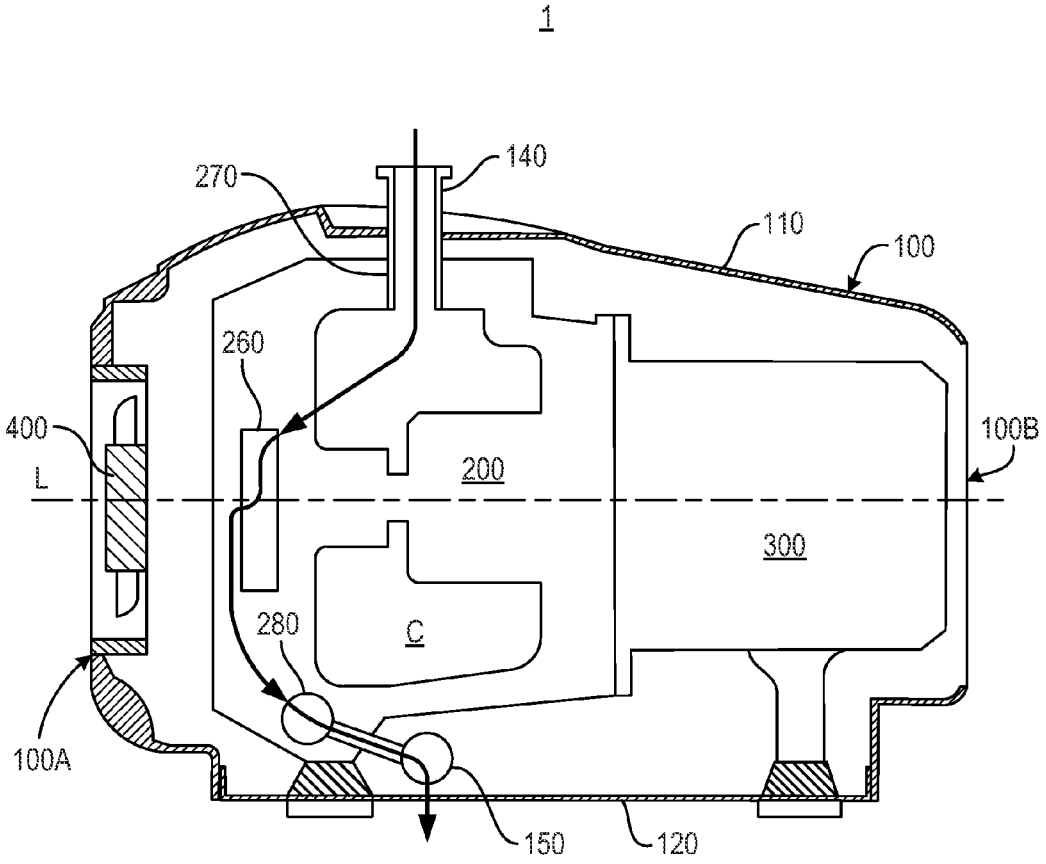
FIG. 1 is a schematic longitudinal sectional view of a scroll pump to which the present invention may be applied.

Various embodiments and examples of embodiments of the inventive concept will be described more fully hereinafter with reference to the accompanying drawings. In the drawings, the sizes and relative sizes of elements may be exaggerated for clarity. Likewise, the shapes of elements may be exaggerated and/or simplified for clarity and elements may be shown schematically for ease of understanding. Also, like numerals and reference characters are used to designate like elements throughout the drawings.

Other terminology used herein for the purpose of describing particular examples or embodiments of the inventive concept is to be taken in context. For example, the terms "comprises" or "comprising" when used in this specification indicates the presence of stated features or processes but does not preclude the presence of additional features or processes. Terms such as "fixed" may be used to describe a direct connection of two parts/elements to one another in such a way that the parts/elements can not move relative to one another or an indirect connection of the parts/elements through the intermediary of one or more additional parts. Likewise, the term "coupled" may refer to a direct or indirect coupling of two parts/elements to one another. The term "spiral" as used to described a scroll blade is used in its most general sense and may refer to any of the various forms of scroll blades known in the art as having a number of turns or "wraps". Finally, as would be readily apparent to those skilled in the art, the term "compliance" as an inherent characteristic of the flexure has a meaning similar to that of springs. That is, the term "compliance" is a vector quantity similar to the displacement vector of a spring. Thus, a phrase such as "the compliance of the flexure is in an axial direction" indicates that the axial direction is the direction along which a predetermined (designed for) relationship exists between the deflection of the flexure and the resulting force of the flexure.

Referring now to FIG. 1, a scroll vacuum pump 1 to which the present invention can be applied may include a cowling 100, and a pump head assembly 200, a pump motor 300, and a cooling fan 400 disposed in the cowling 100. Furthermore, the cowling 100 defines an air inlet 100A and an air outlet 100B at opposite ends thereof, respectively. The cowling 100 may also include a cover 110 that covers the pump head assembly 200 and pump motor 300, and a base 120 that supports the pump head assembly 200 and pump motor 300. The cover 110 may be of one or more parts and is detachably connected to the base 120 such that the cover 110 can be removed from the base 120 to access the pump head assembly 200. Furthermore, the motor 300 is detachably connected to the pump head assembly 200 so that once the cover 110 is removed from the base 120, for example, the motor 300 can be removed from the pump head assembly 200 to provide better access to the pump head assembly for maintenance and/or trouble shooting.

Figure 2:
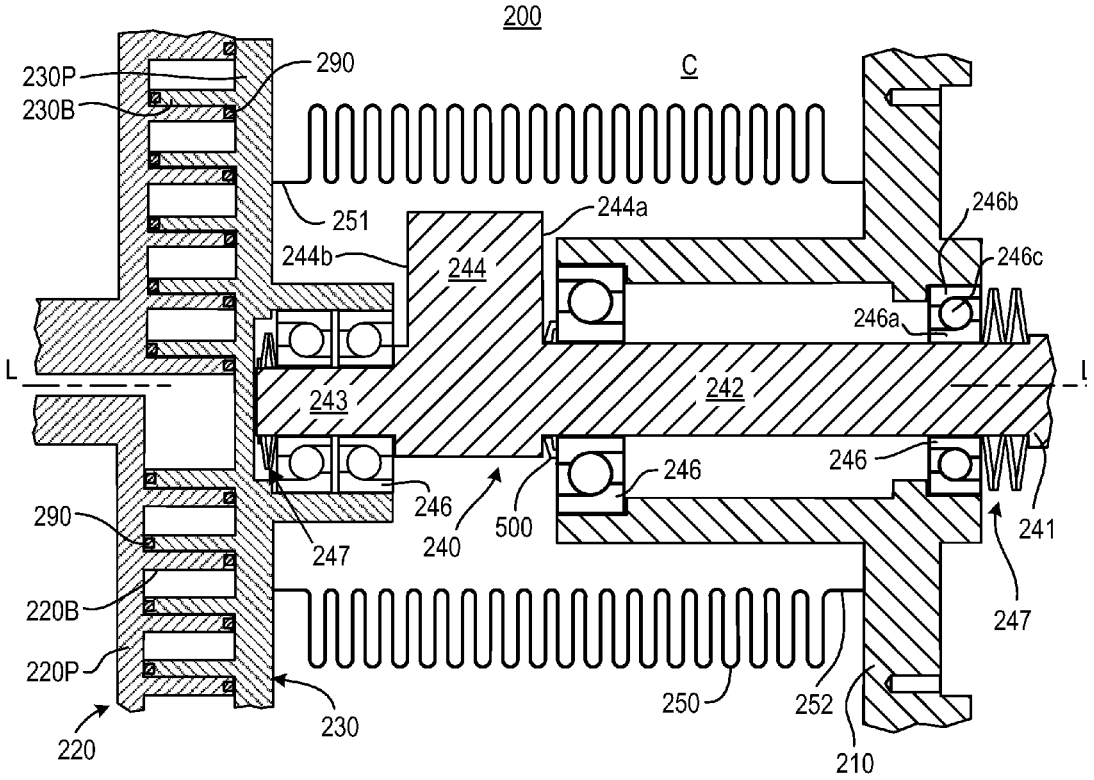
FIG. 2 is a longitudinal sectional view of part of a pump head of one embodiment of a scroll pump according to the present invention.

Referring now to FIG. 2, the pump head assembly 200 includes a frame 210, a stationary plate scroll 220, an orbiting plate scroll 230, and an eccentric drive mechanism 240.

The frame 210 may be one unitary piece, or the frame 210 may comprise several integral parts that are fixed to one another.

The stationary plate scroll 220 in this example is detachably mounted to the frame 210 (by fasteners, not shown). The stationary plate scroll 220 includes a stationary plate 220P, and a stationary scroll blade 220B projecting axially from a front side of the plate 220P. The stationary scroll blade 220B is in the form of a spiral having a number of wraps as is known per se. The orbiting plate scroll 230 includes an orbiting plate 230P, and an orbiting scroll blade 230B projecting axially from a front side of the plate 230P. The orbiting scroll blade 230B has wraps that are complementary to those of the stationary scroll blade 220B.

The stationary scroll blade 220B and the orbiting scroll blade 230B are nested, as shown in FIG. 2, with a clearance and predetermined relative angular and axial positioning such that pockets are delimited by and between the stationary and orbiting scroll blades 220B and 230B during operation of the pump to be described in detail below. In this respect, the sides of the scroll blades 220B and 230B may not actually contact each other to seal the pockets. Rather, minute clearances between sidewall surfaces of the scroll blades 220B and 230B along with tip seals 290 create seals sufficient for forming satisfactory pockets.

The eccentric drive mechanism 240 includes a drive shaft 241 and a number of bearings 246. As shown in FIG. 2, each bearing 246 may have an inner race 246*a*, an outer race 246*b* and rolling elements 246*c* interposed between the inner and outer races. Also, in the embodiment shown in FIG. 2, the drive shaft 241 includes a crankshaft having a main portion 242 and a crank 243, and a counterbalance 244. The counterbalance 244 may be unitary with the main portion 242 and crank 243 or may be fitted around an outer circumferential surface of the same. In any case, the main portion 242 of the crankshaft is coupled to the motor 300 so that the drive shaft 241 is rotated by the motor 300. The central longitudinal axis of the crank 243 is offset in a radial direction from that of the main portion 242.

The main portion 242 of the crankshaft is supported by the frame 210 via one or more of the bearings 246 so as to be rotatable relative to the frame 210 about central longitudinal axis L. In this example, the main portion 242 of the crankshaft is supported by the frame 210 via a pair of angular contact bearings 246. The orbiting plate scroll 230 is mounted to the crank 243 via at least one other bearing 246. In this example, as well, the orbiting plate scroll 230 is mounted to the crank 243 via a second pair of angular contact bearings 246. Thus, the orbiting plate scroll 230 is carried by crank 243 via the angular contact bearings 246 so as to orbit about the longitudinal axis L of the pump when the main shaft 242 is rotated by the motor 300, and so as to be rotatable about the central longitudinal axis of the crank 243.

During a normal operation of the pump, a load applied to the orbiting scroll blade 230B, due to the fluid being compressed in the pockets, tends to act in such a way as to cause the orbiting scroll plate 230 to rotate about the central longitudinal axis of the crank 243. However, a tubular member 250 whose ends 251 and 252 are connected to the orbiting plate scroll 230 and frame 210, respectively, and/or another mechanism such as an Oldham coupling restrains the orbiting plate scroll 230 in such a way as to allow it to orbit about the longitudinal axis L of the pump while inhibiting its rotation about the central longitudinal axis of the crank 243.

In the illustrated embodiment of the present invention, a tubular member 250 in the form of a metallic bellows restrains the orbiting plate scroll 230. The metallic bellows is radially flexible enough to allow the first end 251 thereof to follow along with the orbiting plate scroll 230 while the second end 252 of the bellows remains fixed to the frame 210. Furthermore, the tubular metallic bellows has some flexibility in the axial direction, i.e., in the direction of its central longitudinal axis. On the other hand, the metallic bellows may have a torsional stiffness that prevents the first end 251 of the bellows from rotating significantly about the central longitudinal axis of the bellows, i.e., from rotating significantly in its circumferential direction, while the second end 252 of the bellows remains fixed to the frame 210. Accordingly, the metallic bellows may be essentially the only means of providing the angular synchronization between the stationary and orbiting scroll blades 220B and 230B, respectively, during the operation of the pump.

The tubular member 250 also extends around a portion of the crankshaft and the bearings 246 of the eccentric drive mechanism 240. In this way, the tubular member 250 seals the bearings 246 and bearing surfaces from a space defined between the tubular member 250 and the frame 210 in the radial direction and which space may constitute the working chamber C, i.e., a vacuum chamber of the pump, through which fluid worked by the pump passes. Accordingly, lubricant employed by the bearings 246 and/or particulate matter generated by the bearings surfaces can be prevented from passing into the chamber C by the tubular member 250.

Referring back to FIG. 1, the scroll vacuum pump 1 also has a pump inlet 140 and constituting a vacuum side of the pump where fluid is drawn into the pump, and a pump outlet 150 and constituting a compression side where fluid is discharged to atmosphere or under pressure from the pump. The pump head assembly 200 also has an inlet opening 270 connecting the inlet 140 of the pump to the vacuum chamber C, and an exhaust opening 280 leading to the pump outlet 150. Also, in FIG. 1, reference numeral 260 designates a compression mechanism of the pump which is constituted by the pockets defined between the stationary and orbiting plate scrolls 220 and 230.

Figure 3:
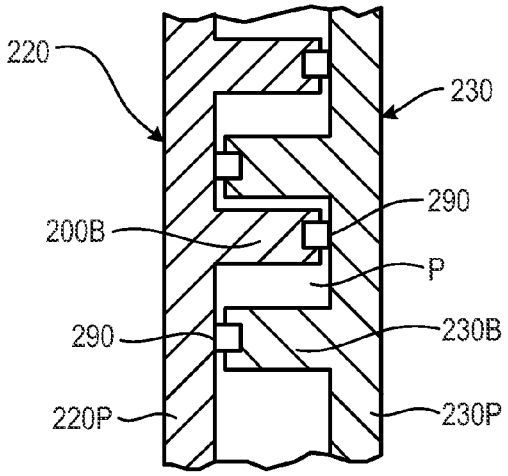
FIG. 3 is an enlarged sectional view of part of the pump head shown in FIG. 2, illustrating tip seals between the stationary plate scroll and the orbiting plate scroll.

FIGS. 2 and 3 show the tip seal(s) 290 of the pump head assembly 200 which creates an axial seal between the scroll blade of one of the orbiting and stationary plate scrolls and the plate (or floor) of the other of the orbiting and stationary plate scrolls. More specifically, the tip seal 290 is a solid plastic member seated in a groove in and running the length of the tip of the scroll blade 220B, 230B of one of the stationary and orbiting plate scrolls 220, 230 so as to be interposed between the tip of the scroll blade 220B, 230B and the plate of the other of the stationary and orbiting plate scrolls 220, 230. In this embodiment, solid plastic tip seals 290 are associated with both of the scroll blades 220B, 230B, respectively. Also, in FIG. 3, reference character P designates an arbitrary one of the above-mentioned pockets.

A scroll vacuum pump 1 having the structure described above operates as follows.

The orbiting motion of the orbiting scroll blade 220B relative to the stationary scroll blade 230B causes the volume of a lead pocket P sealed off from the outlet 150 of the pump and in open communication with the inlet 140 of the pump to expand. Accordingly, fluid is drawn into the lead pocket P through the pump inlet 140 via the inlet opening 270 of the pump head assembly 200 and the vacuum chamber C. The orbiting motion also in effect moves the pocket P to a position at which it is sealed off from the chamber C and hence, from the inlet 140 of the pump, and is in open communication with the pump outlet 150 after one or more revolutions of the crank shaft 241. Then the pocket P is in effect moved into open communication with the outlet opening 280 of the pump head assembly 200. During this time, the volume of the pocket P is reduced. Thus, the fluid in the pocket P is compressed and thereby discharged from the pump through the outlet 150. Also, during this time (which corresponds to one or more orbit(s) of the orbiting plate scroll 230), a number of successive or trailing pockets P may be formed between the stationary and orbiting scroll blades 220B and 230B and are in effect similarly and successively moved and have their volumes reduced. Thus, the compression mechanism 260 in this example is constituted by a series of pockets P. In any case, as shown schematically in FIG. 1 by the arrow-headed lines, the fluid is forced through the pump due to the orbiting motion of the orbiting plate scroll 230 relative to the stationary plate scroll 220.

Also, by virtue of the above-described operation, the fluid flows behind the tip seals 290 and in effect "energizes" the tips seals 290, meaning that the fluid forces the tip seals against the plates of the opposing plates scrolls. The pump 1 may be assembled with less axial clearance than the axial height of the tip seal also forcing the tip seal against the plate of the opposing plate scroll. One problem with a solid tip seal, as was described earlier, is that it does not provide sufficient axial compliance because such a tip seal is relatively incompressible. Thus, normally, when the pump is built and, in particular, when the pump head is assembled, the orbiting plate scroll must be set at a precise axial position in the pump to ensure that each tip seal produces an effective seal. Typically, this axial position must be within ~0.001 inches of a reference position. Also, as is clear from the background section of this disclosure, an effective seal means one that produces a sufficient seal of the pocket P without generating excessive friction and heat.

The present invention, in one respect, obviates the need for such a precise assembly process of the pump head. In particular, according to one aspect of the invention, an axial compliance system comprising a flexure is provided.

Figure 5:
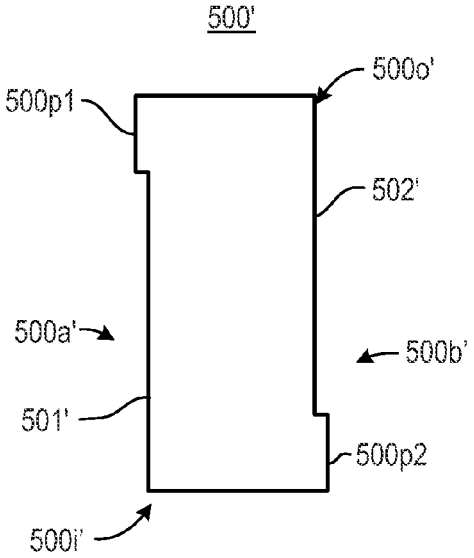
FIG. 5 is a cross-sectional view, in a radial direction, of another version of a flexure employed by a scroll pump according to the present invention.
Figure 4:
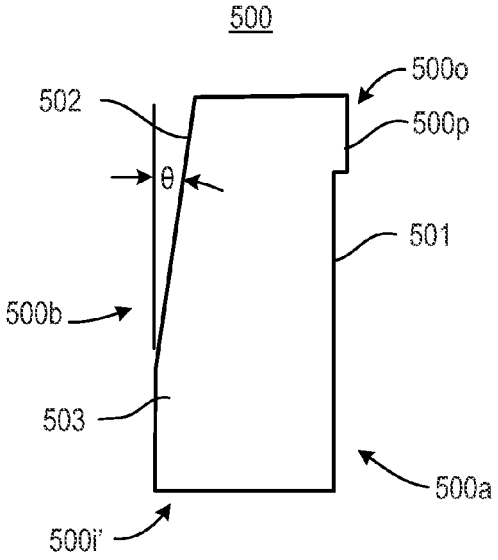
FIG. 4 is a cross-sectional view, in a radial direction, of one version of a flexure employed by a scroll pump according to the present invention.

The flexure is interposed between a flexure-locating surface and a flexure-locating bearing of the eccentric drive mechanism 240 as disposed in contact with the flexure-locating surface. The flexure-locating surface is a surface of the drive shaft 241 that extends outwardly from an outer circumferential surface of the drive shaft 241. One version of the flexure 500 is shown in FIG. 4 and another version of the flexure 500' is shown in FIG. 5. The flexures 500 and 500', and the overall axial compliance system comprising the flexure 500 or 500', will now be described in more detail below.

The axial compliance system may also include a set of springs 247 such as Belleville springs or Belleville washers. The springs 247 serve to pre-load the bearings 246. The flexure-locating bearing 246 is biased by and between at least one of the disk springs 247 and the flexure 500 (or 500'). Also, in the embodiment of FIG. 2, for reasons that will become clear, at least the flexure-locating bearing 246 is disposed on the drive shaft 241 such that the drive shaft 241 is axially movable relative to (the inner race of) the flexure-locating bearing 246. To this end, the coefficient of thermal expansion of the material of the drive shaft 241 should match that of the bearing(s) 246 or there should be an appropriate level of radial clearance between the shaft 241 and the bearing(s). Note, in the illustrated embodiment of FIG. 2, all of the bearings 246 are disposed on the drive shaft 241 such that the drive shaft 241 is axially movable relative to (the inner races of) the bearings 246, and six disk springs 247 are employed, for example, to pre-load the bearings 246.

Also, the embodiment of FIG. 2 is shown as employing the flexure 500 of FIG. 4, as an example, but other types of flexures such as that later shown in and described with respect to FIG. 5 may be employed instead.

Referring still to the embodiment of FIG. 2, the flexure-locating surface is a surface 244*a* of the counterbalance 244 of the eccentric drive mechanism 240. The flexure-locating surface 244*a* extends outwardly in a radial direction relative to an outer circumferential surface of the main portion 242 of the drive shaft 241. The flexure-locating bearing in this embodiment is a bearing 246 which mounts the drive shaft 241 to the frame 210 (the left-most one of the angular contact bearings disposed on the main shaft 242 in the figure). The flexure 500 is disposed in contact with the flexure-locating surface 244*a* and may contact the flexure-locating bearing 246. Also, in this example, the flexure-locating bearing 246 is biased by and between a set of four of the disk springs 247 (right hand side of the figure) and the flexure 500.

Moreover, the flexure 500 has compliance in an axial direction parallel to the longitudinal axis L of the pump.

To this end, and referring to FIGS. 2 and 4, the flexure 500 is an annular member having first and second opposite sides 500*a* and 500*b* and radially innermost and outermost portions 500*i* and 500*o*. Referring particularly to FIG. 4, the first side 500*a* of the annular member has an annular first surface 501 extending substantially perpendicular to a central axis of the annular member, and a cylindrical projection 500*p* that projects, at the radially outermost portion 500*o* of the annular member, axially from the first surface 501 in a direction parallel to the central axis of the annular member. The second side 500*b* of the annular member has a frustum-shaped second surface 502 extending obliquely relative to the central axis of the annular member towards the first side 500*a* of the annular member. The second side 500*b* may also have an annular third surface 503 at the radially innermost portion of the flexure 500 and extending substantially perpendicular to the central axis of the annular member. Thus, the second surface 503 subtends an acute angle θ with a plane perpendicular to the central axis of the annular member.

In the embodiment of FIG. 2, the projection 500*p* of the flexure contacts the inner race of the flexure-locating bearing 246, and the radially innermost portion 500*i* of the second side 500*b* of the flexure contacts the flexure-locating surface 244*a*. Specifically, the third surface 503 of the flexure 500 contacts the flexure-locating surface 244*a*. Accordingly, the compliance of the flexure 500 is in a region between the inner race of the flexure-locating bearing 246 and the locating surface 244*a*.

In the version of the flexure 500' shown in FIG. 5, the flexure 500' is also an annular member having first and second opposite sides 500*a*' and 500*b*' and radially innermost and outermost portions 500*i*' and 500*o*'. The first side 500*a*' of the annular member has an annular first surface 501' extending substantially perpendicular to a central axis of the annular member, and a cylindrical first projection 500*p*1 that projects axially at the radially outermost portion 500*o*' of the annular member from the first surface 501' in a first direction parallel to the central axis of the annular member. On the other hand, the second side 500*b*' of the annular member has an annular second surface 502' extending substantially perpendicular to the central axis of the annular member, and a cylindrical second projection 500*p*2 that projects axially at the radially innermost portion 500*i*' of the annular member from the second surface 502' in a second direction opposite to the first direction.

Thus, in the case in which the flexure 500' is employed instead of the flexure 500 in the embodiment of FIG. 2 (refer to FIGS. 6A, 6B and 6C and the description thereof that follows), the first projection 500*p*1 of the flexure contacts the inner race of the flexure-locating bearing 246, and the second projection 500*p*2 of the flexure 500' contacts the flexure-locating surface 244*a*. Thus, in this case as well, the compliance of the flexure 500' would be in a region between the inner race of the flexure-locating bearing 246 and the flexure-locating surface 244*a*.

Also, in the embodiment of FIG. 2, the angular contact bearings 246 by which the orbiting plate scroll 230 is mounted to the crank 243 are set against a radially extending surface of the counterbalance 244. Those angular contact bearings 246 are urged against that surface by a set of two of the disk springs 247 (held in place on the crank 243 by a clip, for example) to thereby pre-load the bearings.

Figure 6A:
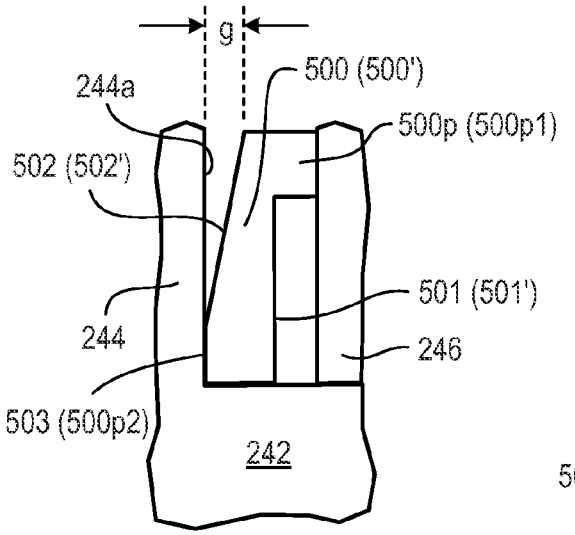
FIGS. 6A, 6B and 6C are each a conceptual diagram of a portion of the embodiment of the scroll pump of FIG. 2 in section, with FIG. 6A showing a flexure in an essentially relaxed (non-deflected state), FIG. 6B showing the flexure in a deflected state, and FIG. 6C showing the flexure in a deflected hard-stopped state.

Basically, the flexure 500 (or 500') is engineered so that its spring rate satisfies two conditions. First, the pre-load exerted on the bearings 246 (by the disk springs 247) should deflect the flexure 500 (or 500') by only a relatively small amount (for instance, 0.001" in the case in which the pre-load is 350 lbf) so that when there is a vacuum in the stage 260 of the pump axial loads will not result in the orbiting plate scroll moving towards the stationary plate scroll 220 by an excessive amount. The second condition is that the spring rate of the flexure 500 (or 500') should be low enough so that a relatively small spring force will urge the orbiting plate scroll 230 away from the stationary plate scroll 220 when the axial clearance between the tip seal(s) 290 and the opposing plate is too small. With respect to the latter condition, the flexure 500 (or 500') allows the orbiting plate scroll 230 to move away from the stationary plate scroll 220 in the event that an excessively small gap is provided between the tip seal(s) 290 and the plate of the opposing plate scroll when the pump head of the pump is assembled such as at the time the pump is built. This is shown in FIGS. 6A, 6B and 6C.

In a working example of the embodiment of FIG. 2, in the case in which the spring rate of the flexure 500 (or 500' is engineered so that a relatively modest force of ~350 lbf will deflect the flexure 500 (or 500') by 0.001" in the axial direction, the spring rate of the flexure 500 (or 500') is approximately 350,000 lbf/in, which is relatively small compared to the "spring rate" of a solid plastic tip seal (considering that the tip seal is essentially incompressible). FIG. 6A shows an ideal state of assembly in which an optimal seal(s) is established by the tip seal(s). In this case, a gap g between the radially outermost portion of the flexure 500 (or 500') and the flexure-locating surface 244*a* is 0.006" and there is minimal deflection of the flexure 500 (or 500').

Figure 6B:
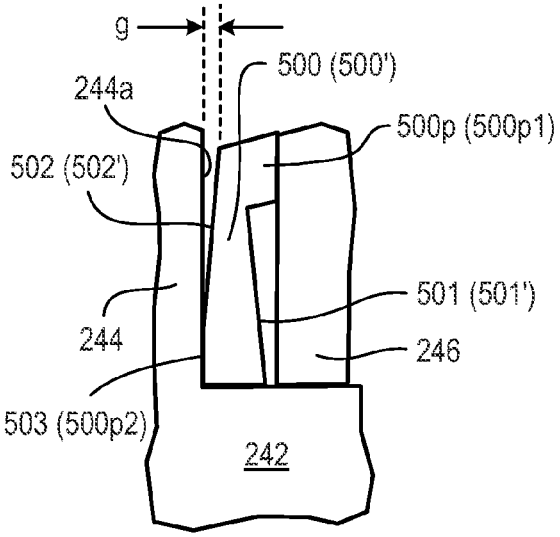

FIG. 6B shows the state in which the flexure 500 (or 500') has allowed the orbiting plate scroll 230 to move away from the stationary plate scroll 220 in the case in which the assembly of the pump head would otherwise result in the tip seal(s) being fitted too tightly against the opposing plate. In this case, the maximum allowable tolerance of the pump head in the axial direction was off by 0.003" whereby deflection of the flexure 500 (or 500') reduced the axial gap g between the radially outermost portion of the flexure 500 (or 500) and the flexure-locating surface 244*a* to 0.003". At this time, the reaction force of the flexure 500 (or 500') in the axial direction as transmitted to the tip seal(s) is only approximately 1050 lbs. Without the flexure 500 (or 500', the reaction force could easily be an order of magnitude higher. Note, also, the reaction force of 1050 lbs., which would be transmitted to the angular contact bearings 246 disposed on the crank 243, is sufficient to keep the bearings 243 from separating from each other in the axial direction.

Figure 6C:
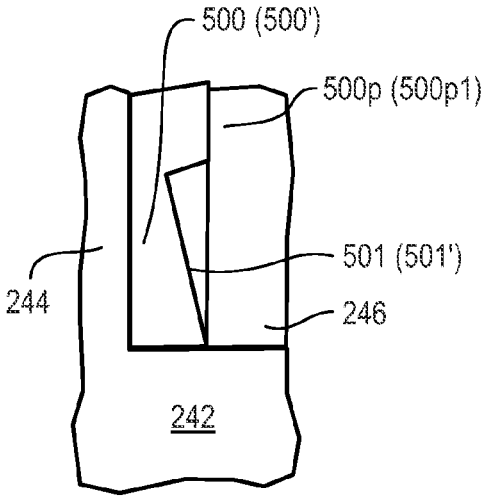

FIG. 6C shows a state in which the flexure 500 (or 500') has limited the movement of the orbiting scroll plate 230 away from the stationary scroll plate 220. That is, the flexure 500 (or 500') is configured to provide a hard stop for the axial compliance system.

Figure 7A:
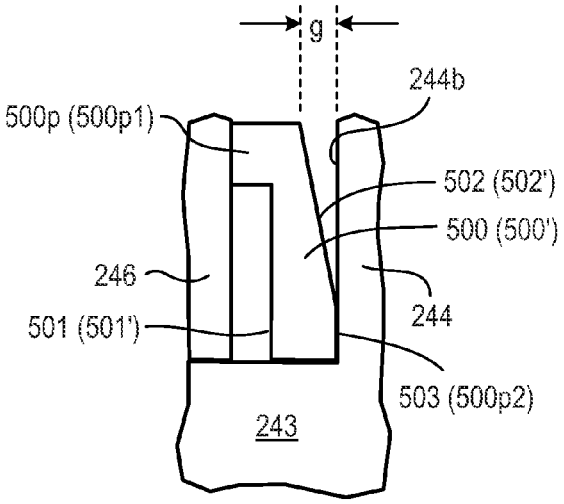
FIGS. 7A, 7B and 7C are each a conceptual diagram of a portion of another embodiment of a scroll pump according to the present invention in section, with FIG. 7A showing a flexure in an essentially relaxed (non-deflected state), FIG. 7B showing the flexure in a deflected state, and FIG. 7C showing the flexure in a deflected hard-stopped state.
Figure 7B:
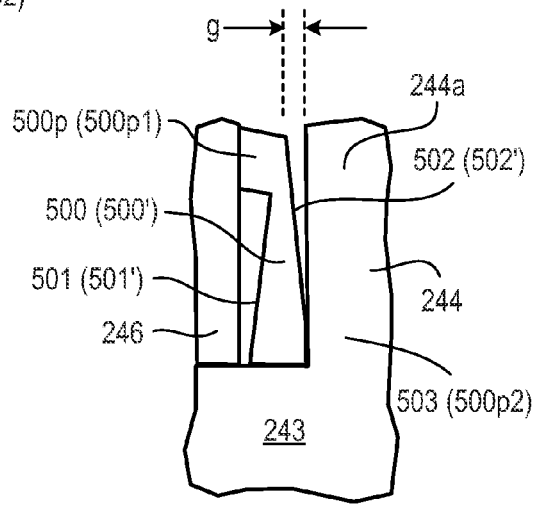
Figure 7C:
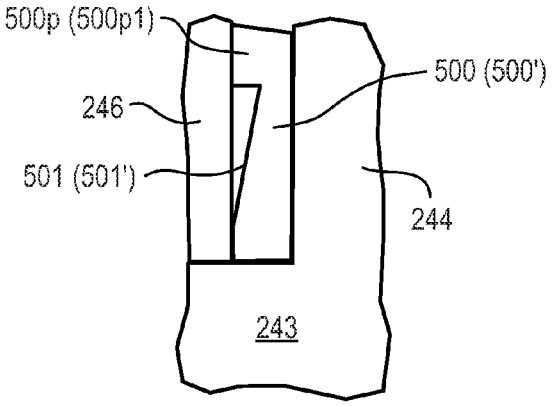

FIGS. 7A, 7B and 7C show another embodiment according to the present invention. In this embodiment, the flexure 500 (or 500') is interposed between the pair of angular contact bearings 246 by which the orbiting plate scroll 230 is mounted to the crank 243 and a flexure-locating surface. The flexure-locating surface in this embodiment may be a surface 244*b* of the counterbalance 244 (refer to FIG. 2). More specifically, the flexure 500 (or 500') contacts the inner race of the angular contact bearing 246 remote from the orbiting plate scroll 230 and the pair of disk springs 247 that pre-load the angular contact bearings 246. Furthermore, the flexure 500 (or 500) may contact the flexure-locating surface 244*b*. In any case, the compliance of the flexure 500 (or 500') is in a region between the inner race of the angular contact bearing 246 and the flexure-locating surface 244*b*.

FIGS. 7A, 7B and 7C show states corresponding to those shown in FIGS. 6A, 6B and 6C, respectively. Thus, FIGS. 7A, 7B and 7C show that the same results and advantages can be achieved when the flexure 500 (500') is interposed between the angular contact bearings 246 on which the orbiting plate scroll 230 is disposed and a flexure-locating surface of the drive shaft 241.

Finally, embodiments of the inventive concept and examples thereof have been described above in detail. The inventive concept may, however, be embodied in many different forms and should not be construed as being limited to the embodiments described above. Rather, these embodiments were described so that this disclosure is thorough and complete, and fully conveys the inventive concept to those skilled in the art. Thus, the true spirit and scope of the inventive concept is not limited by the embodiment and examples described above but by the following claims.

What is claimed is:

1. A scroll pump, comprising:

a frame;

a stationary plate scroll fixed relative to the frame and having a stationary plate, and a scroll blade projecting axially from the stationary plate in a direction parallel to a longitudinal axis of the pump;

an orbiting plate scroll including an orbiting plate, and an orbiting scroll blade projecting axially from the orbiting plate in a direction parallel to the longitudinal axis, and nested with the stationary scroll blade, at least one tip seal, each said at least one tip seal interposed between an axial end of the scroll blade of a respective one of the stationary plate and orbiting plate scrolls and the plate of the other of the stationary plate and orbiting plate scrolls;

an eccentric drive mechanism supported by the frame and operative to drive the orbiting plate scroll in an orbit about the longitudinal axis, and including a counterbalance, a drive shaft, and bearings, the drive shaft comprising a crankshaft having a main shaft and a crank, the orbiting plate scroll being carried by the crank, and the main shaft of the crankshaft being supported by the frame via said bearings, and wherein the eccentric drive mechanism has an axially facing flexure-locating surface, one of the bearings is a flexure-locating bearing, the crankshaft is supported such that it is movable axially relative to the flexure-locating bearing, and the flexure-locating surface is a surface counterbalance; and a flexure axially interposed between said axially facing flexure-locating surface and said flexure-locating bearing, the flexure having compliance in an axial direction parallel to the longitudinal axis of the pump and configured to enable movement of the flexure-locating surface to position the orbiting plate scroll in the axial direction.

2. The scroll pump as claimed in claim 1, wherein the flexure-locating bearing is disposed on the main shaft of the crank shaft and coupled to the frame.

3. The scroll pump as claimed in claim 2, wherein the flexure-locating bearing has an inner race disposed on the main shaft of said crank shaft, an outer race coupled to the frame and rolling elements interposed between the inner and outer races, and said flexure contacts the inner race of the bearing, whereby the compliance of the flexure is in a region between the inner race and said flexure-locating surface.

4. The scroll pump as claimed in claim 1, wherein the bearings comprise a pair of angular contact bearings by which the orbiting plate scroll is mounted to the crank, each of the angular contact bearings including an inner race disposed on the crank, an outer race coupled to the orbiting plate scroll and rolling elements interposed between the inner and outer races, and said flexure-locating bearing is one of the angular contact bearings.

5. The scroll pump as claimed in claim 4, wherein the flexure contacts the inner race of said one of the angular contact bearings, whereby the compliance of the flexure is in a region between the inner race of said one of the angular contact bearings and said flexure-locating surface.

6. The scroll pump as claimed in claim 1, wherein the flexure is an annular member having first and second opposite sides and radially innermost and outermost portions, the first side of the flexure has a first surface extending substantially perpendicular to a central axis of the annular member, and a projection that projects, at the radially outermost portion of the flexure, axially from the first surface in a direction parallel to the central axis of the annular member, and the second side of the flexure has a second surface extending obliquely relative to the central axis of the flexure towards the first side of the flexure, whereby the second surface subtends an acute angle with a plane extending perpendicular to the central axis of the flexure.

7. The scroll pump as claimed in claim 6, wherein the flexure-locating bearing has an inner race disposed on the main shaft of said crankshaft, an outer race coupled to the frame and rolling elements interposed between the inner and outer races, the projection of the flexure contacts the inner race of said bearing, and the radially innermost portion of the second side of the flexure contacts said flexure-locating surface, whereby the compliance of the flexure is in a region between the inner race of said flexure-locating bearing and the flexure-locating surface.

8. The scroll pump as claimed in claim 6, wherein the bearings comprise a pair of angular contact bearings by which the orbiting plate scroll is mounted to the crank, each of the angular contact bearings including an inner race disposed on the crank, an outer race coupled to the orbiting plate scroll and rolling elements interposed between the inner and outer races, said flexure-locating bearing is one of the angular contact bearings, the projection of the flexure contacts the inner race of said one of the angular contact bearings, and the radially innermost portion of the second side of the flexure contacts said flexure-locating surface, whereby the compliance of the flexure is in a region between the inner race of said one of the angular contact bearings and said flexure-locating surface.

9. The scroll pump as claimed in claim 6, wherein the second side of the flexure has a third surface at the radially innermost portion of the flexure and extending substantially perpendicular to the central axis of the flexure, the third surface is disposed in contact with said flexure-locating surface, and the second surface extends from the third surface to the radially outermost portion of the flexure.

10. The scroll pump as claimed in claim 1, wherein the flexure is an annular member having first and second opposite sides and radially innermost and outermost portions, the first side of the flexure has a first surface extending substantially perpendicular to a central axis of the annular member, and a first projection that projects axially at the radially outermost portion of the flexure from the first surface in a first direction parallel to the central axis of the annular member, and the second side of the flexure has a second surface extending substantially perpendicular to the central axis of the annular member, and a second projection that projects axially at the radially innermost portion of the flexure from the second surface in a second direction opposite to the first direction.

11. The scroll pump as claimed in claim 10, wherein the flexure-locating bearing has an inner race disposed on the main shaft of said crank shaft, an outer race coupled to the frame and rolling elements interposed between the inner and outer races, the first projection of the flexure contacts the inner race of said bearing, and the second projection of the flexure contacts said flexure-locating surface.

12. The scroll pump as claimed in claim 10, wherein the bearings comprise a pair of angular contact bearings by which the orbiting plate scroll is mounted to the crank, each of the angular contact bearings including an inner race disposed on the crank, an outer race coupled to the orbiting plate scroll and rolling elements interposed between the inner and outer races, said flexure-locating bearing is one of the angular contact bearings, the first projection of the flexure contacts the inner race of said one of the angular contact bearings, and the second projection of the flexure contacts said flexure-locating surface, whereby the compliance of the flexure is in a region between the inner race of said one of the angular contact bearings and said flexure-locating surface.

13. A scroll pump, comprising:

a frame;

a stationary plate scroll fixed relative to the frame and having a stationary plate, and a scroll blade projecting axially from the stationary plate in a direction parallel to a longitudinal axis of the pump;

an orbiting plate scroll including an orbiting plate, and an orbiting scroll blade projecting axially from the orbiting plate in a direction parallel to the longitudinal axis, and nested with the stationary scroll blade, at least one tip seal, each said at least one tip seal interposed between an axial end of the scroll blade of a respective one of the stationary plate and orbiting plate scrolls and the plate of the other of the stationary plate and orbiting plate scrolls;

an eccentric drive mechanism supported by the frame and operative to drive the orbiting plate scroll in an orbit about the longitudinal axis, the eccentric drive mechanism including a drive shaft, and bearings each having an inner race, an outer race and rolling elements interposed between the inner and out races, the drive shaft comprising a crankshaft having a main shaft and a crank, the outer races of respective ones of the bearings being coupled to the frame and the orbiting plate scroll, and the inner races of the respective ones of the bearings being disposed on the main shaft and the crank, whereby the main shaft is supported by the frame and the orbiting plate scroll is carried by the crank via the bearings, and wherein the eccentric drive mechanism has an axially facing flexure-locating surface, and the crankshaft is supported such that it is movable axially relative to the inner races of the bearings; and an axial compliance system including at least one spring by which the inner races of the bearings are clamped axially, and a flexure interposed in an axial direction, parallel to the longitudinal axis of the pump, between the inner race of one of the bearings and said axially facing flexure-locating surface of the eccentric drive mechanism, the flexure having compliance in said axial direction.

14. The scroll pump as claimed in claim 13, wherein the flexure is an annular member having first and second opposite sides and radially innermost and outermost portions, the first side of the flexure has a first surface extending substantially perpendicular to a central axis of the annular member, and a projection that projects, at the radially outermost portion of the flexure, axially from the first surface in a direction parallel to the central axis of the annular member, and the second side of the flexure has a second surface extending obliquely relative to the central axis of the flexure towards the first side of the flexure, whereby the second surface subtends an acute angle with a plane extending perpendicular to the central axis of the flexure.

15. The scroll pump as claimed in claim 13, wherein the flexure is an annular member having first and second opposite sides and radially innermost and outermost portions, the first side of the flexure has a first surface extending substantially perpendicular to a central axis of the annular member, and a first projection that projects axially at the radially outermost portion of the flexure from the first surface in a first direction parallel to the central axis of the annular member, and the second side of the flexure has a second surface extending substantially perpendicular to the central axis of the of the annular member, and a second projection that projects axially at the radially innermost portion of the flexure from the second surface in a second direction opposite to the first direction.

16. The scroll pump as claimed in claim 13, wherein the at least one disk spring comprises first and second disk springs between which the inner races of the bearings are clamped in place.

17. A scroll pump comprising:

a frame;

a stationary plate scroll fixed relative to the frame and having a stationary plate, and a scroll blade projecting axially from the stationary plate in a direction parallel to a longitudinal axis of the pump;

an orbiting plate scroll including an orbiting plate, and an orbiting scroll blade projecting axially from the orbiting plate in a direction parallel to the longitudinal axis, and nested with the stationary scroll blade, at least one tip seal, each said at least one tip seal interposed between an axial end of the scroll blade of a respective one of the stationary plate and orbiting plate scrolls and the plate of the other of the stationary plate and orbiting plate scrolls;

an eccentric drive mechanism supported by the frame and operative to drive the orbiting plate scroll in an orbit about the longitudinal axis, and including a drive shaft and bearings, the drive shaft comprising a crankshaft having a main shaft and a crank, the orbiting plate scroll being carried by the crank, and the main shaft of the crankshaft being supported by the frame via said bearings, and wherein the eccentric drive mechanism has an axially facing flexure-locating surface, one of the bearings is a flexure-locating bearing, and the crankshaft is supported such that it is movable axially relative to the flexure-locating bearing;

a flexure axially interposed between said axially facing flexure-locating surface and said flexure-locating bearing, the flexure having compliance in an axial direction parallel to the longitudinal axis of the pump and configured to enable movement of the flexure-locating surface to position the orbiting plate scroll in the axial direction; and at least one spring, and wherein the flexure-locating bearing is biased by and between the at least one spring and the flexure.

* * * * *